US008698059B2

(12) United States Patent
Nikkel et al.

(10) Patent No.: US 8,698,059 B2
(45) Date of Patent: Apr. 15, 2014

(54) DEPLOYABLE LIFTING SURFACE FOR AIR VEHICLE

(75) Inventors: Jonathan P. Nikkel, Vail, AZ (US); Anthony K. Tyree, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 16 days.

(21) Appl. No.: 13/462,944

(22) Filed: May 3, 2012

(65) Prior Publication Data

US 2013/0291753 A1 Nov. 7, 2013

(51) Int. Cl.
*F42B 10/16* (2006.01)

(52) U.S. Cl.
USPC ..... 244/3.27; 244/38

(58) Field of Classification Search
USPC ..... 244/3.24, 3.25, 3.26, 3.28, 3.29, 3.3, 244/35 R, 38, 39, 198, 201, 219, 46, 49, 244/45 A
See application file for complete search history.

(56) References Cited

U.S. PATENT DOCUMENTS

| | | | | | |
|---|---|---|---|---|---|
| 1,166,879 | A | | 1/1916 | Alard | |
| D194,647 | S | * | 2/1963 | Brown | D12/333 |
| 3,103,886 | A | * | 9/1963 | Popenoe | 244/3.29 |
| 3,188,957 | A | * | 6/1965 | Petre | 244/3.27 |
| 3,194,514 | A | * | 7/1965 | Rogallo | 244/49 |
| 3,197,158 | A | * | 7/1965 | Rogallo | 244/49 |
| 3,374,969 | A | * | 3/1968 | Rhodes | 244/3.27 |
| 3,434,254 | A | | 3/1969 | Rubin | |
| 4,485,991 | A | * | 12/1984 | Fuller | 244/49 |
| 4,607,810 | A | | 8/1986 | Frazer | |
| 4,699,334 | A | * | 10/1987 | Boeder | 244/3.23 |
| 4,736,908 | A | * | 4/1988 | Boder | 244/3.29 |
| 4,736,909 | A | * | 4/1988 | Boder et al. | 244/3.29 |
| 4,752,052 | A | * | 6/1988 | Galvin | 244/3.29 |
| 4,796,835 | A | * | 1/1989 | Galvin | 244/3.29 |
| 4,964,593 | A | | 10/1990 | Kranz | |
| 5,368,255 | A | * | 11/1994 | August | 244/3.28 |
| 5,417,393 | A | * | 5/1995 | Klestadt | 244/3.27 |
| 5,642,867 | A | * | 7/1997 | Klestadt | 244/49 |
| 5,927,643 | A | * | 7/1999 | Figge, Sr. | 244/3.27 |
| 6,557,798 | B1 | | 5/2003 | Giesenberg et al. | |
| 7,090,163 | B2 | * | 8/2006 | Rastegar et al. | 244/3.28 |
| 7,163,176 | B1 | | 1/2007 | Geswender et al. | |
| 7,331,546 | B2 | * | 2/2008 | Ifju et al. | 244/123.1 |
| 7,354,017 | B2 | | 4/2008 | Morris et al. | |
| 7,412,930 | B2 | | 8/2008 | Smith et al. | |
| 7,448,339 | B2 | * | 11/2008 | Bruengger et al. | 114/244 |

(Continued)

*Primary Examiner* — Benjamin P Lee
(74) *Attorney, Agent, or Firm* — Renner, Otto, Boisselle & Sklar, LLP

(57) ABSTRACT

An air vehicle includes a fuselage, and one or more lifting surfaces attached to the fuselage. The lifting surfaces deploy form a stowed, compact condition, to a deployed condition in which the lifting surfaces are deployed to provide lift to the air vehicle. The lifting surfaces each include a top member and a bottom member, which are joined at leading and trailing edges, such as by welds along the seams, or by flexible material placed along the seams. In deploying the thickness of the lifting surfaces increase, with middle portions of the members (portions of the members between the leading and trailing edges) moving away from one another. This may be accompanied by a lessening of the chord of the lifting surface, with the leading edge and the trailing edge moving closer together as the lifting surface deploys.

21 Claims, 13 Drawing Sheets

(56) References Cited

U.S. PATENT DOCUMENTS

| | | | | |
|---|---|---|---|---|
| 7,790,261 | B2 * | 9/2010 | Liggett | 428/57 |
| 8,096,848 | B2 * | 1/2012 | Hollis | 446/62 |
| 8,201,773 | B1 * | 6/2012 | Durham et al. | 244/49 |
| 8,274,025 | B2 * | 9/2012 | Geswender et al. | 244/3.27 |
| 2004/0245393 | A1 * | 12/2004 | Ifju et al. | 244/123 |
| 2006/0284005 | A1 * | 12/2006 | Ifju et al. | 244/49 |
| 2010/0282895 | A1 | 11/2010 | Geswender | |
| 2013/0099050 | A1 * | 4/2013 | Sanderson et al. | 244/49 |

* cited by examiner

DEPLOYABLE LIFTING SURFACE FOR AIR VEHICLE

BACKGROUND OF THE INVENTION

1. Field of the Invention

The invention is in the field of deployable lifting surfaces, and in air vehicles having deployable lifting surfaces.

2. Description of the Related Art

Air vehicles launched from tubes or other devices, or stowed in compact form for storage and transportation, may be severely limited in lifting surface size and/or configuration, because of the need (for example) for wings to fit within a launcher or container envelope. This limitation on wings limits the performance of tube-launched or other deployable air vehicles. Improvement in deployable wings and other lifting surfaces would therefore be desirable.

SUMMARY OF THE INVENTION

According to an aspect of the invention, a lifting surface includes an upper member and a lower member. The lifting surface deploys from a stowed condition in which the lifting surface is wrapped around part of a fuselage.

According to another aspect of the invention, an air vehicle includes: a fuselage; and one or more lifting surfaces that deploy from a stowed condition, with the one or more lifting surfaces wrapped around at least part of the fuselage, to a deployed condition. The one or more lifting surfaces each have a top member and a bottom member, with the top member and the bottom member connected at a leading edge and a trailing edge of the lifting surface, and with the top member and the bottom member have a greater physical separation from one another, between the leading edge and the trailing edge, when the lifting surface is in the deployed condition, compared to when the lifting surface is in the stowed condition.

According to yet another aspect of the invention, an air vehicle includes: a fuselage; and one or more surfaces that deploy from a stowed condition, with the one or more surfaces wrapped around at least part of the fuselage, to a deployed condition. The one or more surfaces are secured by a combustible restraint in the stowed configuration, and burning of the combustible restraint releases the one or more surfaces to the deployed condition.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An air vehicle includes a fuselage, and one or more lifting surfaces attached to the fuselage. The lifting surfaces deploy form a stowed, compact condition, to a deployed condition in which the lifting surfaces are deployed to provide lift to the air vehicle. The lifting surfaces each include a top member and a bottom member, which are joined at leading and trailing edges, such as by welds along the seams, or by flexible material placed along the seams. In deploying the thickness of the lifting surfaces increase, with middle portions of the members (portions of the members between the leading and trailing edges) moving away from one another. This may be accompanied by a lessening of the chord of the lifting surface, with the leading edge and the trailing edge moving closer together as the lifting surface deploys. The deploying may include the bowing out of the members, with the members being curved in opposite directions with the lifting surface in the deployed condition.

Figure 1:
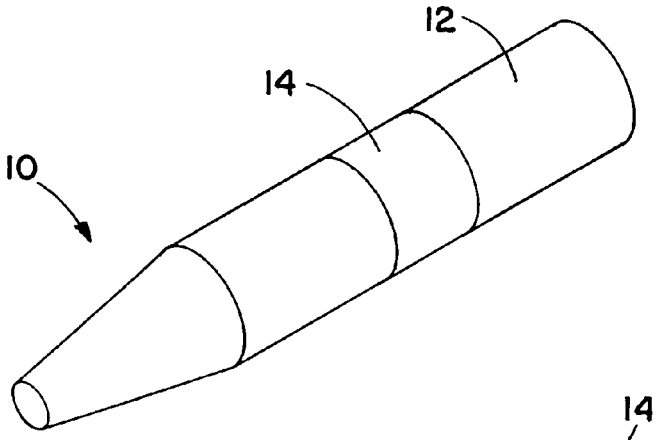
FIG. 1 is an oblique view of an air vehicle according to an embodiment of the invention, with a lifting surface of the air vehicle in a stowed condition.
Figure 2:
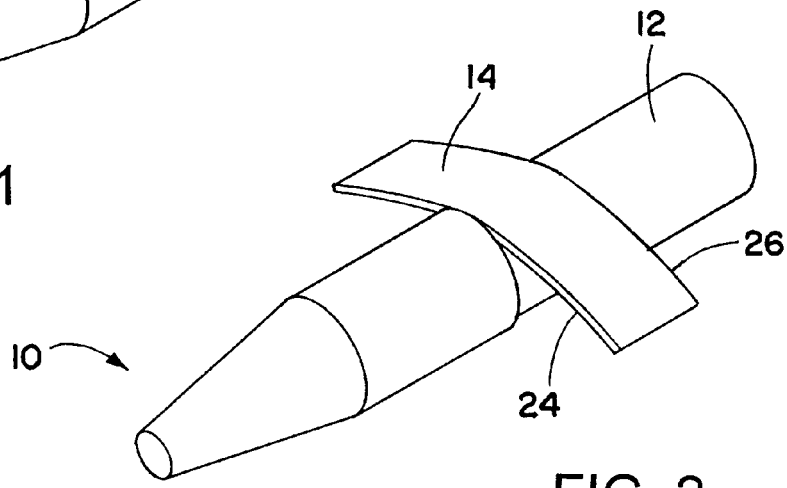
FIG. 2 is an oblique view of the air vehicle of FIG. 1, with the lifting surface in a deployed condition.

FIGS. 1 and 2 show an air vehicle 10 that includes a fuselage 12 and a lifting surface 14 that is mechanically coupled to the fuselage (vehicle body) 12. The lifting surface 14 in the illustrated embodiment is a wing, but the lifting surface 14 alternatively may be any of a variety of other lift-producing surfaces, such as canards or fins. Also alternatively the wing may be considered as two separate (left and right) lifting surfaces. The lifting surface 14 deploys from a stowed condition, illustrated in FIG. 1, to a deployed condition, illustrated in FIG. 2. In the stowed condition the lifting surface 14 may wrap around the fuselage 12, enabling the air vehicle to fit within a launcher, such as a launch tube (not shown). In the deployed condition the lifting surface 14 provides lift or other control to the air vehicle 10. The lifting surface 14 has an airfoil shape that increases in thickness as it deploys from the stowed condition to the deployed condition.

Figure 3:
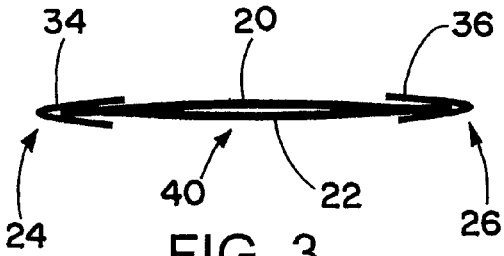
FIG. 3 is a cross-sectional view of one embodiment of the air vehicle lifting surface of FIG. 1, with the lifting surface in the stowed condition.
Figure 4:
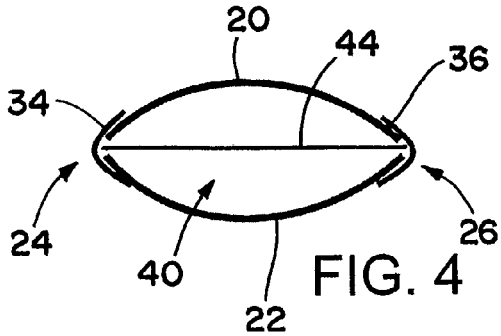
FIG. 4 is a cross-sectional view of the lifting surface of FIG. 3, with the lifting surface in the deployed condition.

With reference now in addition to FIGS. 3 and 4, the lifting surface 14 includes a top member 20 that provides a top surface to the airfoil that is the lifting surface 14, and a bottom member 22 that provides a bottom surface to the lifting surface 14. The members 20 and 22 may be made of a material with some flexibility, such as sheet metal like spring steel, or a carbon-fiber-reinforced plastic material. The flexibility of the members 20 and 22 allows the members 20 and 22 to bend to be able to be in either the stowed condition or the deployed condition. The rotational elasticity of the material chosen for members 20 and 22 provides an overall restoring torque, when in the stowed condition, that rotates the members 20 and 22 to the deployed condition from the stowed condition, once released, without the need for a separate actuator device.

The members 20 and 22 are joined together at a leading edge 24 and a trailing edge 26 of the lifting surface 14. In the illustrated embodiment a front flexible material 34 connects the members 20 and 22 together at the leading edge 24, and a back flexible material 36 connects the members 20 and 22 together at the trailing edge 26. The flexible material may be a flexible fabric material, such as a reinforced fabric (e.g., a fiber-reinforced fabric) that allows flexibility at the leading edge 24 and the trailing edge 26.

The lifting surface 14 increases in thickness as the surface 14 deploys. When the lifting surface 14 is in the stowed condition (FIG. 3), the lifting surface 14 is in a relatively thin condition, with little space between the members 20 and 22 in a mid-chord position 40 that is between the leading edge 24 and the trailing edge 26. In the stowed condition the members 20 and 22 may be in contact with one another, or may be close to one another in the mid-chord position 40. The members 20 and 22 may have curvature or chamber in the same direction, with one of the members 20 and 22 nesting in the other of the members 20 and 22, as the lifting surface 14 is stowed around or next to the fuselage 12. In the stowed configuration the members 20 and 22 buckle in the same direction, for example being wrapped around the fuselage 12.

In the deployed condition (FIG. 4), the lifting surface 14 has an increased thickness, with the members 20 and 22 for example bowing out away from each other in the mid-chord position 40 between the leading edge 24 and the trailing edge 26. In the deployed condition the members 20 and 22 are curved or chambered in opposite directions, providing a better airfoil shape for generating lift. The airfoil shape may be symmetric, with the top member 20 and the bottom member 22 having substantially similar shapes extending in opposite directions from a centerline 44 between the leading edge 24 and the trailing edge 26. The centerline 44 in the illustrated embodiment is in a substantially horizontal direction, with the members 20 and 22 extending in opposite vertical directions. Alternatively the centerline 44 may be in another direction, with for example the leading edge 24 vertically higher than the trailing edge 26 to give the airfoil a nonzero angle of attack. As an alternative to the symmetric airfoil shape, the airfoil shape may be asymmetric, with the top member 20 having a different shape than the bottom member 22.

The lifting surface 14 shown in FIGS. 1-4 provides good lateral (buckling) stiffness, with the degree of lateral stiffness depending on the thickness ratio (thickness/chord) of the volume formed by the members 20 and 22. Thus there is a tradeoff between aerodynamic properties and mechanical properties of the lifting surface 14. The twist angle of the lifting surface 14 can be controlled in order to change the configuration of the lifting surface 14 to control flight of the air vehicle 10, as described further below. Alternatively various types of internal structural members (stiffeners) may be used to provide additional twist stiffness, and/or to control the configuration of the lifting surface 14, as is also described further below. Control may also be exercised by translating or rotating the lifting surface 14 with respect to the fuselage 12.

The members 20 and 22 of the lifting surface 14 may be buckled in the same direction, flattening them together to allow both of the members 20 and 22 to be rolled up into any of a variety of shapes, for stowage around the fuselage 12 (FIG. 1), or otherwise to maintain the lifting surface 14 in a stowed condition. The lifting surface 14 may be biased toward the deployed condition, with the stowed condition only maintained by use of a mechanism or other physical constraints to keep the lifting surface in the stowed condition. The spring force (rotational elasticity) of the stowed lifting surface 14 may provide the restoring force to deploy the lifting surface 14, once the lifting surface 14 is released from the stowed condition.

Figure 5:
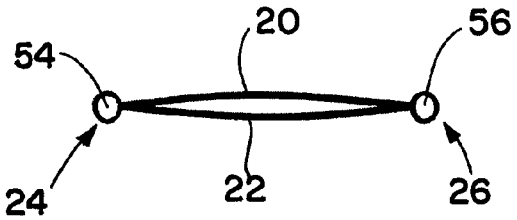
FIG. 5 is a cross-sectional view of another embodiment of the air vehicle lifting surface of FIG. 1, with the lifting surface in the stowed condition.
Figure 6:
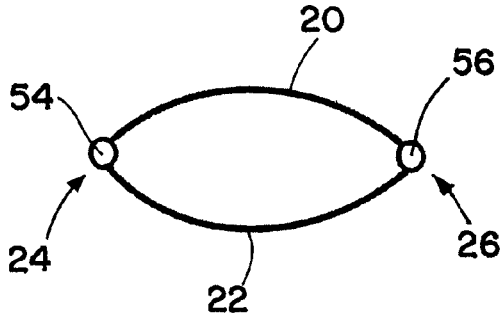
FIG. 6 is a cross-sectional view of the lifting surface of FIG. 5, with the lifting surface in the deployed condition.

FIGS. 5 and 6 show an alternative arrangement for flexibly securing the members 20 and 22. In the alternative arrangement the members 20 and 22 are secured at the leading edge 24 by a leading edge spanwise series of welds 54. The members 20 and 22 are secured at the trailing edge 26 by a trailing edge spanwise series of welds 56. The welds 54 and 56 allow the members 20 and 22 to move relative to one another to achieve both the stowed condition (FIG. 5) and the deployed condition (FIG. 6).

Figure 7:
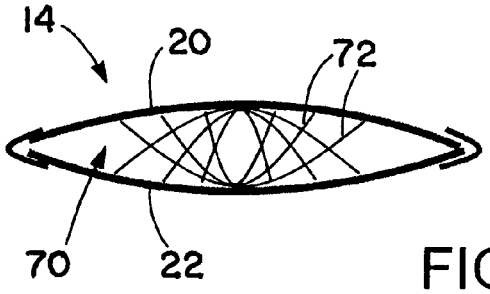
FIG. 7 is a cross-sectional view showing one embodiment of stiffeners or spars for the lifting surface of FIG. 1.

FIGS. 7-10 show various configurations of internal stiffeners 70 that may be used to improve the ability of the lifting surface 14 to withstand external forces, and/or to help aid in reconfiguring the lifting surface 14 for control purposes. FIG. 7 shows interlaced opposing stiffening members 72 that extend from the top member 20 to the bottom member 22. The members 72 may be made of the same material as the top member 20 and the bottom 22, for instance spring steel or carbon-fiber-reinforced plastic material. The stiffening members 72 may be attached to one or the other of the members 20 and 22 (or both), or may not be fixedly attached to either of the members 20 and 22. There may be slip constraint features in the top and bottom members 20 and 22 that limit the movement of the stiffening members 72 relative to the top and bottom members 20 and 22, once the internal members reach the deployed configuration. The stiffening members 72 provide additional resistance to buckling.

Figure 8:
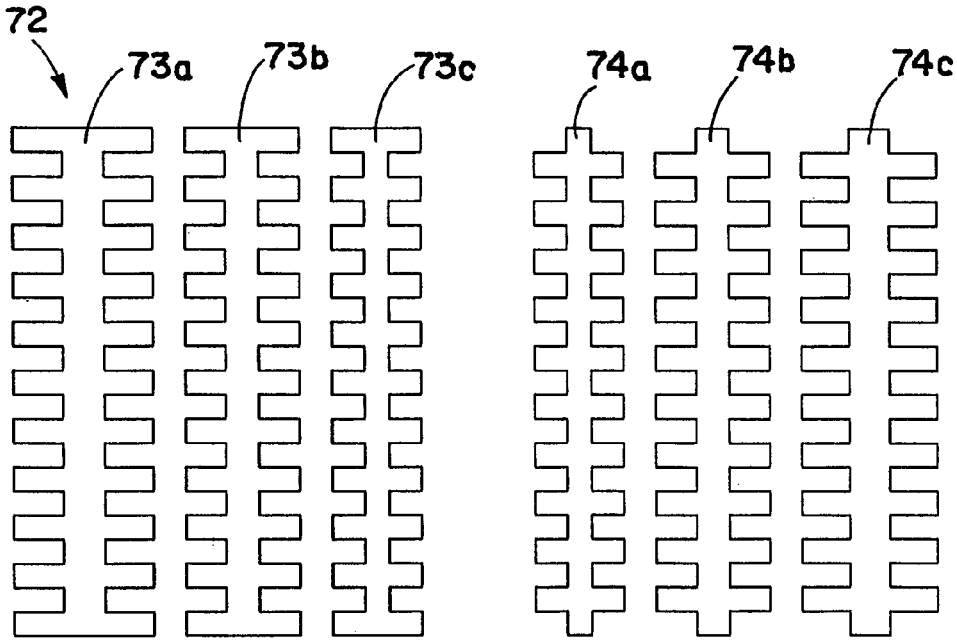
FIG. 8 is a plan view showing the stiffeners of one embodiment of the stiffeners of FIG. 7.

FIG. 8 shows one possible configuration of the stiffening members 72, with upper stiffening members 73*a*, 73*b*, and 73*c*, and with lowering stiffening members 74*a*, 74*b*, and 74*c*. The stiffening members 73*a*-73*c* and 74*a*-74*c* are stacked in the order, top to bottom for example, in the order that they are shown from left to right in FIG. 7B. The stiffening members 73*a*-73*c* and 74*a*-74*c* are slotted, with alternating slots between the upper stiffening members 73*a*-73*c* and the lower stiffening members 74*a*-74*c*. Three different upper stiffening members 73*a*-73*c* correspond to respective of the lower stiffening members 74*a*-74*c*, with the upper member 73*a* paired with the lower member 74*c*, the upper member 73*b* paired with the lower member 74*b*, and the upper member 73*c* paired with the lower member 74*a*. The pairs 73*a* and 74*c*, 73*b* and 74*b*, and 73*c* and 74*a*, constitute three pairs of stiffening members 72 with different resting chord lengths. The configuration of the stiffening members 72 may vary over a wide range of parameters, in including material thickness, geometry of the lifting surface 14, and the number of internal elements used. The stiffening members 72 provide added force to deploy the lifting surface 14, and once deployed, would provide strength against bucking of the lifting surface.

Figure 9:
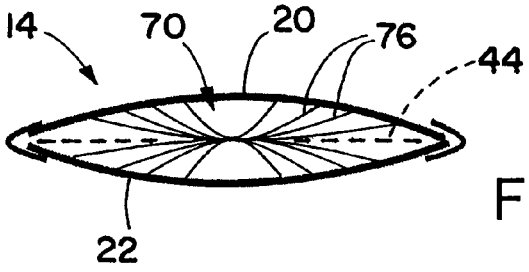
FIG. 9 is a cross-sectional view showing another embodiment of stiffeners or spars for the lifting surface of FIG. 1.

FIG. 9 shows an alternative configuration of the stiffeners 70, with the stiffeners 70 being stiffening members 76 that extend to the top and bottom members 20 and 22 from the centerline 44. The stiffening members 76 form a network of spars that increase the resistance of the lifting member 14 to buckling as well as twisting. As with the stiffening members 72 (FIG. 7), the stiffening members 76 may be made of the same material as the members 20 and 22, may be fixedly attached to or free to slide relative to the members 20 and 22, and may have constraints on their slippage relative to the members 20 and 22.

Figure 10:
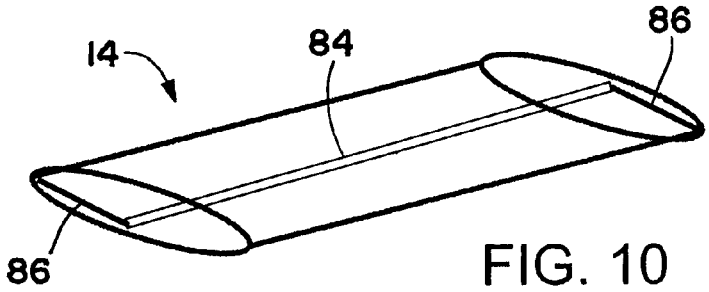
FIG. 10 is an oblique view showing still another embodiment of stiffeners or spars for the lifting surface of FIG. 1.

FIG. 10 is yet another alternative configuration of the stiffeners 70, which includes a torsion chain 84 that is coupled to torsion bars 86 at either end of the lifting surface 14. The torsion chain 84 is a series of interconnected members that can roll up as the lifting surface 14 is put into the stowed condition. When the lifting surface 14 is put into the deployed condition, as is shown in FIG. 10, the chain has good torsional stiffness about the axis of span of the lifting surface 14. The torsion chain 84 may be turned by a suitable actuator, for example a motor or other suitable mechanism, to twist the torsion chain 84. A twist in the torsion chain 84 is transmitted through the torsion bars 86 to twist the lifting surface 14. Twisting the lifting surface 14, such as twisting a wing, can be used to control flight of air vehicle 10 (FIG. 1). The lifting surface 14 would be restrained in the center, with the ends free to twist. By deforming the lifting surface 14 by twisting, the aerodynamic forces on the lifting surfaces 14 may be varied, to steer the air vehicle 10. The torsion chain 84 and the torsion bars 86 provide additional stiffness against undesired twisting of the lifting surface 14, whether or not there is active control of the shape of the lifting surface 14.

In the illustrated embodiment the torsion bars 86 each stretch from the torsion chain 84 to respective contact points on the perimeter of the lifting surface 14. Alternatively the torsion bars 86 each may have two contact points on the perimeter of the lifting surface 14, for example extending across the ends of the lifting surface 14, coupled at their centers to the torsion chain 84.

Figure 11:
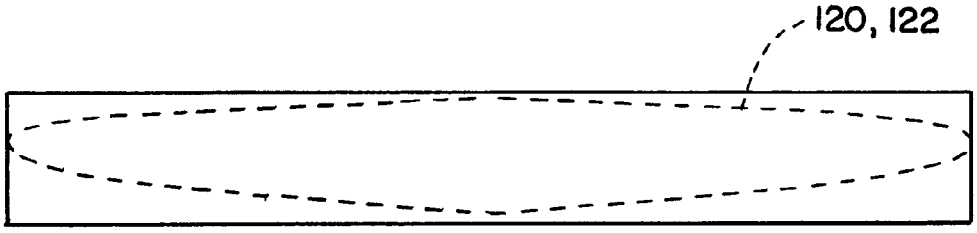
FIG. 11 is a plan view of an alternate embodiment of the top member and the bottom member according to the invention.

FIG. 11 shows an alternative, with a tapered shape for top and bottom members 120 and 122, vary the chord across the span. The resulting lifting surface may have any of a wide variety of suitable tapered shapes.

Figure 12:
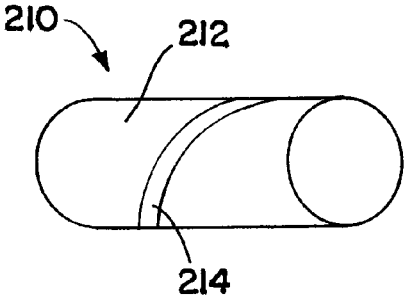
FIG. 12 is an oblique view of an air vehicle according to an alternate embodiment of the invention, with the lifting surfaces in a stowed condition.
Figure 13:
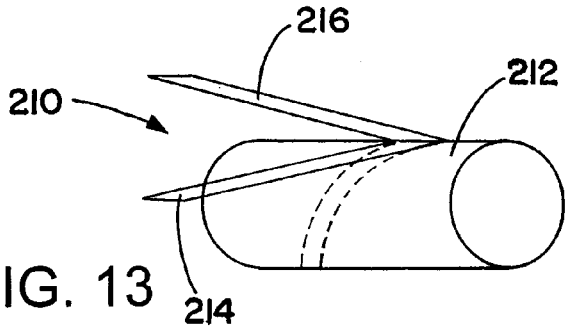
FIG. 13 is an oblique view of the air vehicle of FIG. 12, with the lifting surfaces in a deployed condition.

FIGS. 12 and 13 show another alternative, with an air vehicle 210 having lifting surfaces 214 and 216 that have sweep. The lifting surfaces 214 and 216 are wings that wrap around a fuselage 212 about an alternate axis that has the lifting surfaces wrapped at changing axial locations parallel to a longitudinal axis 220. The lifting surfaces 214 and 216 deploy as swept-back wings, providing different aerodynamic properties than straight wings.

The features of various embodiments described herein may be combined in a single device, where appropriate. Combinations of different features in the same device may provide all of the advantages of the individual features. In addition the combination of different features may provide additional advantages not found in either of the individual features.

Figure 14:
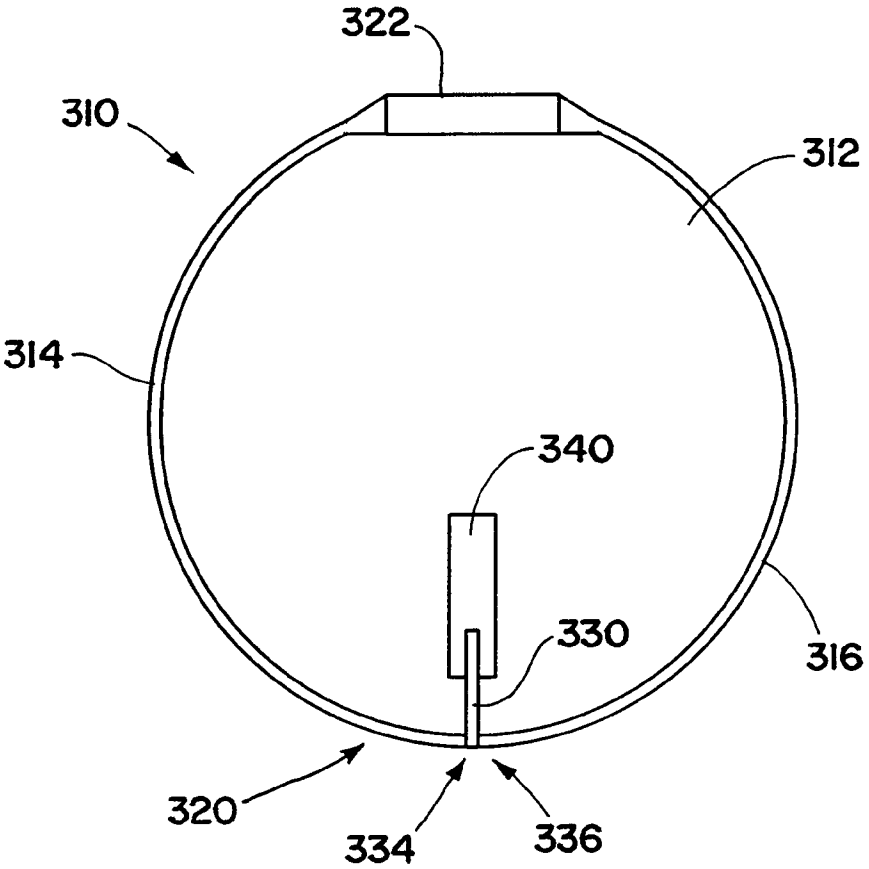
FIG. 14 is a cross-sectional view from the front of an air vehicle according to another alternate embodiment of the invention, with a lifting surface of the air vehicle in the stowed condition.
Figure 15:
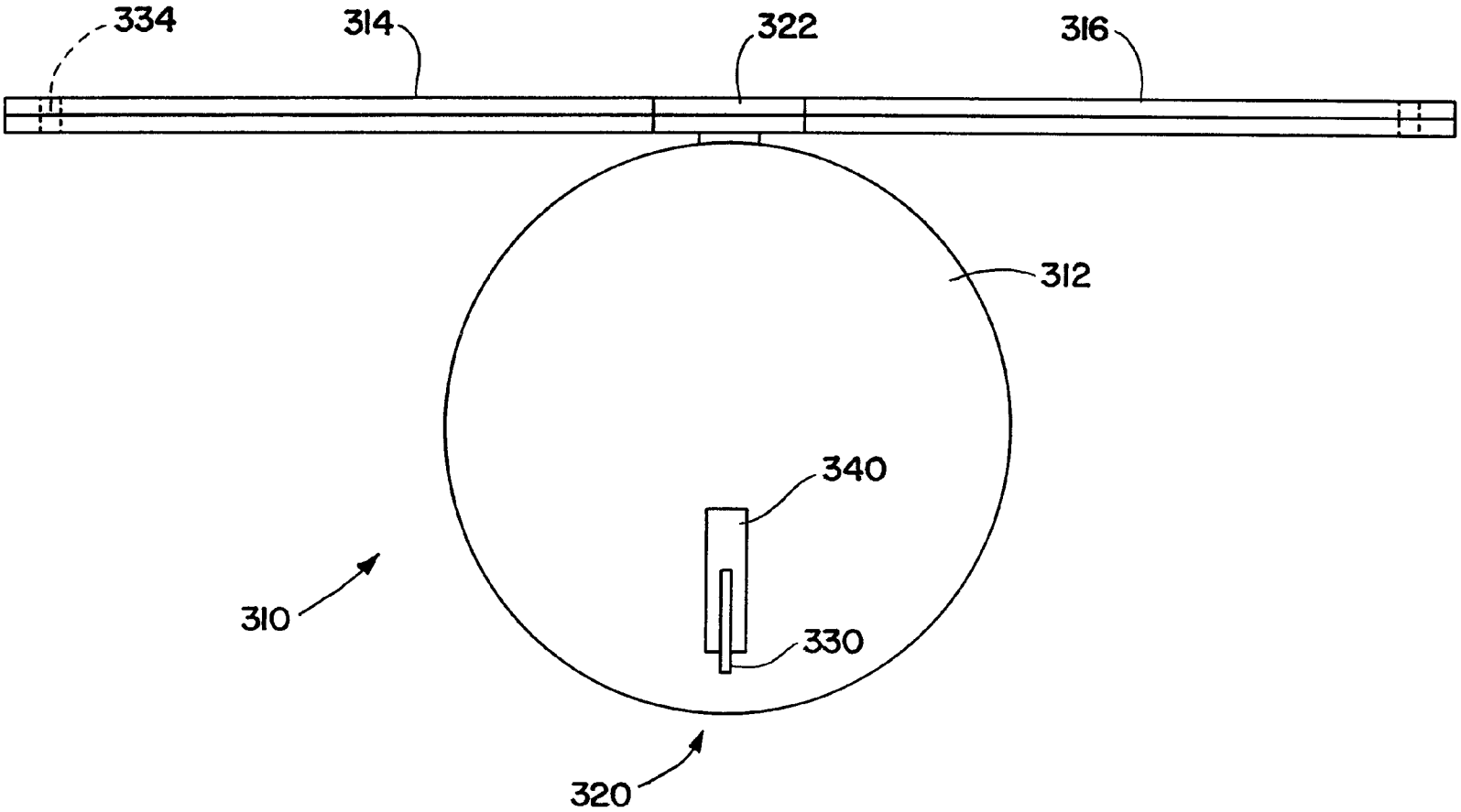
FIG. 15 is a cross-sectional view from the front of the air vehicle of FIG. 14, with the lifting surface in a deployed condition.

FIGS. 14 and 15 show an air vehicle 310, illustrating one mechanism 320 for securing lifting surfaces 314 and 316 around a fuselage 312 in a stowed condition until deployment is desired. The lifting surfaces 314 and 316 extend outward from a center stiffening box 322 that is in turn attached to the fuselage 312. The stiffening box 322 may be a rectangular metal box or stiffening element that provides stiffness to the ends of the lifting surfaces 314 and 316, and to provide a way to securely attach the lifting surfaces 314 and 316 to the fuselage 312.

The mechanism 320 includes a pin 330 that fits into slots or holes 334 and 336 at ends of the lifting surfaces 314 and 316, respectively. The pin 330 engages the slots 334 and 336 to maintain the lifting surfaces 314 and 316 in the stowed condition, illustrated in FIG. 14. Referring to FIG. 15, the mechanism 320 includes a solenoid 340 that is used to retract the pin 330 to release the lifting surfaces 314 and 316. The lifting surfaces 314 and 316 may be biased with spring forces to deploy to the deployed condition illustrated in the figure.

Figure 16:
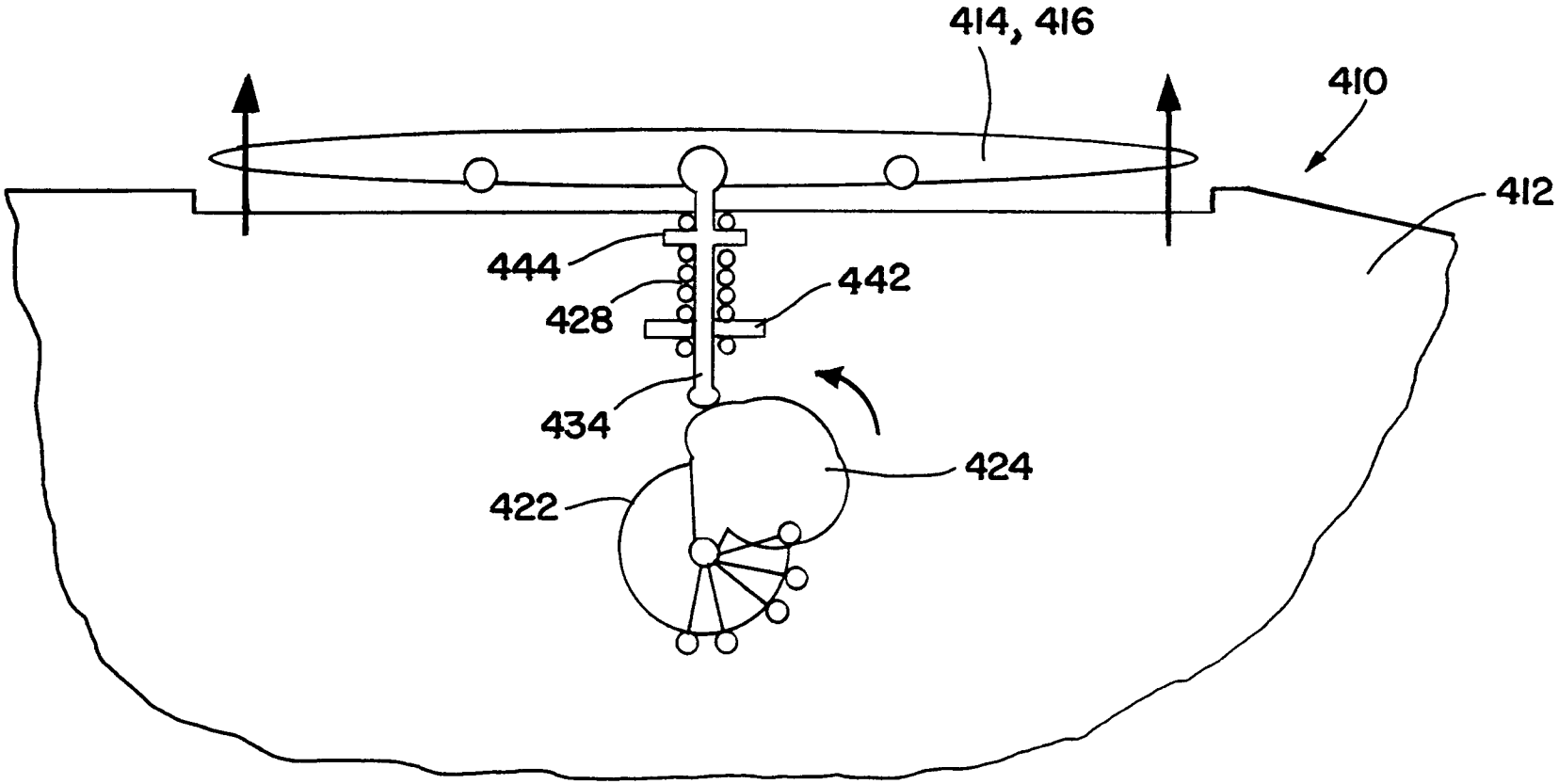
FIG. 16 is a cross-sectional view from the side of an air vehicle according to still another alternate embodiment of the invention, with a lifting surface of the air vehicle in a stowed condition.
Figure 17:
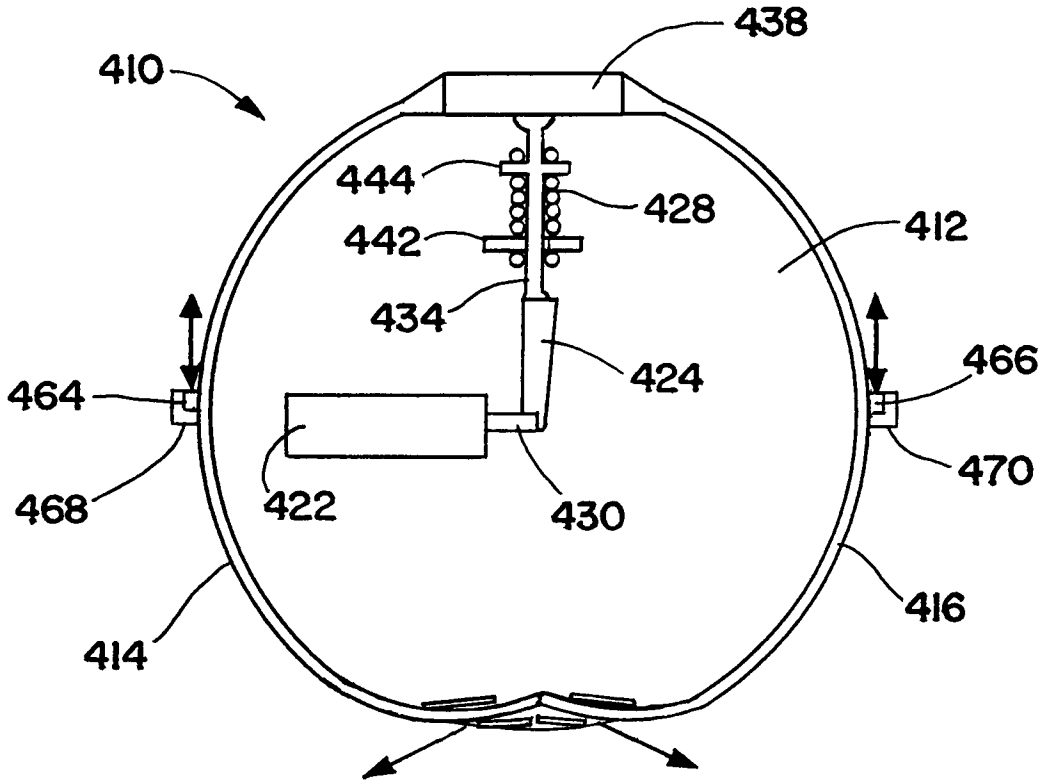
FIG. 17 is a cross-sectional view from the front of the air vehicle of FIG. 16, with the lifting surface in the stowed condition.
Figure 18:
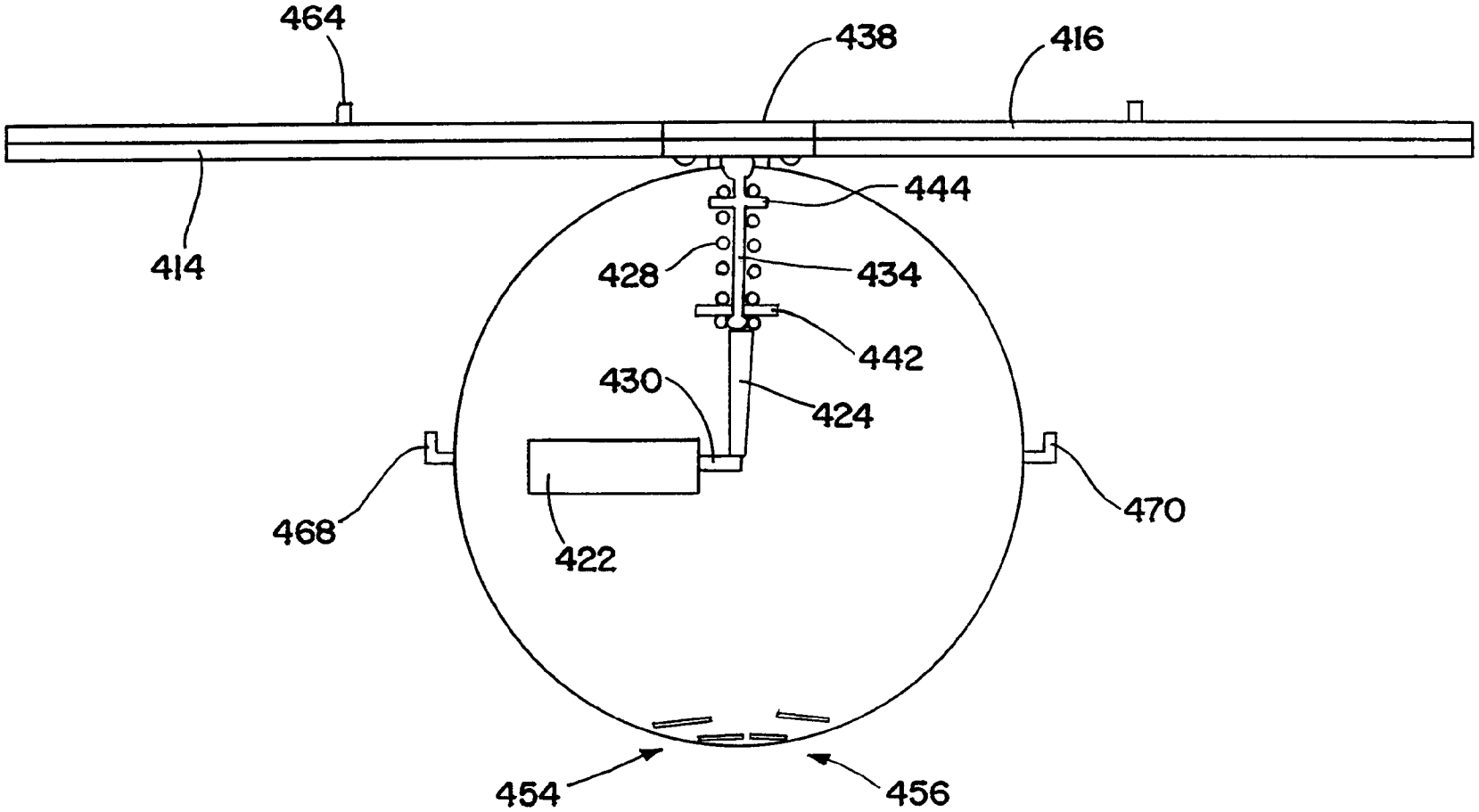
FIG. 18 is a cross-sectional view from the front of the air vehicle of FIG. 16, with the lifting surface in a deployed condition.

FIGS. 16-18 show an air vehicle 410 with a different mechanism 420 for deploying lifting surfaces 414 and 416. The mechanism 420 includes a motor 422, a locking cam 424, and a lock spring 428. The motor 422 turns a shaft 430 which in turns the cam 424. This lifts a follower 434 that is attached to a stiffening box 438 that is secured to the lifting surfaces 414 and 416. The spring 428 is attached on one side to a rigid attachment point 442 on the fuselage 412. On the other side the spring 428 is coupled to the box 438, at an attachment point 444. The spring 428 provides a force that keeps the lifting surfaces 414 and 416 in the stowed condition, with ends of the lifting surfaces 414 and 416 in slots 454 and 456 in the fuselage 412, as shown in FIGS. 16 and 17. Also the lifting surfaces 414 and 416 may have optional restraint tabs 464 and 466, respectively. The restraint tabs 464 and 466 extend forward or aft of the main portions of the lifting surfaces 414 and 416, and fit into and engage respective airframe restraint features 468 and 470 on the fuselage 414, for example with the tabs 464 and 466 sliding into the restraint features 468 and 470. The engagement of the tabs 464 and 466 with the restraint features 468 and 470 aids in retaining the lifting surface 414 and 416 in the stowed condition. The slots 454 and 456, and the restraint features 468 and 470, are examples of mechanical constraints on the fuselage 412 that aid in keeping the lifting surfaces 414 and 416 in the stowed condition. Many other sorts of mechanical constraints may be used as alternatives.

With reference in particular to FIGS. 16 and 18, the deployment of the lifting surfaces 414 and 416 occurs as follows. The motor 422 is used to turn the cam 424, which pushes the follower 434 up against the force from the spring 428. The upward movement of the stiffener box 438 and the lifting surface 414 and 416 puts the restraint tabs 464 and 466 out of engagement with the restraint features 468 and 470. The upward movement also bends the lifting surfaces 414 and 416 further, transferring the tangential force necessary to pull the ends of the lifting surfaces 414 and 416 out from the slots 454 and 456. The spring force in the lifting surfaces 414 and 416 thereafter causes the lifting surfaces 414 and 416 to deploy, as shown in FIG. 18.

Figure 19:
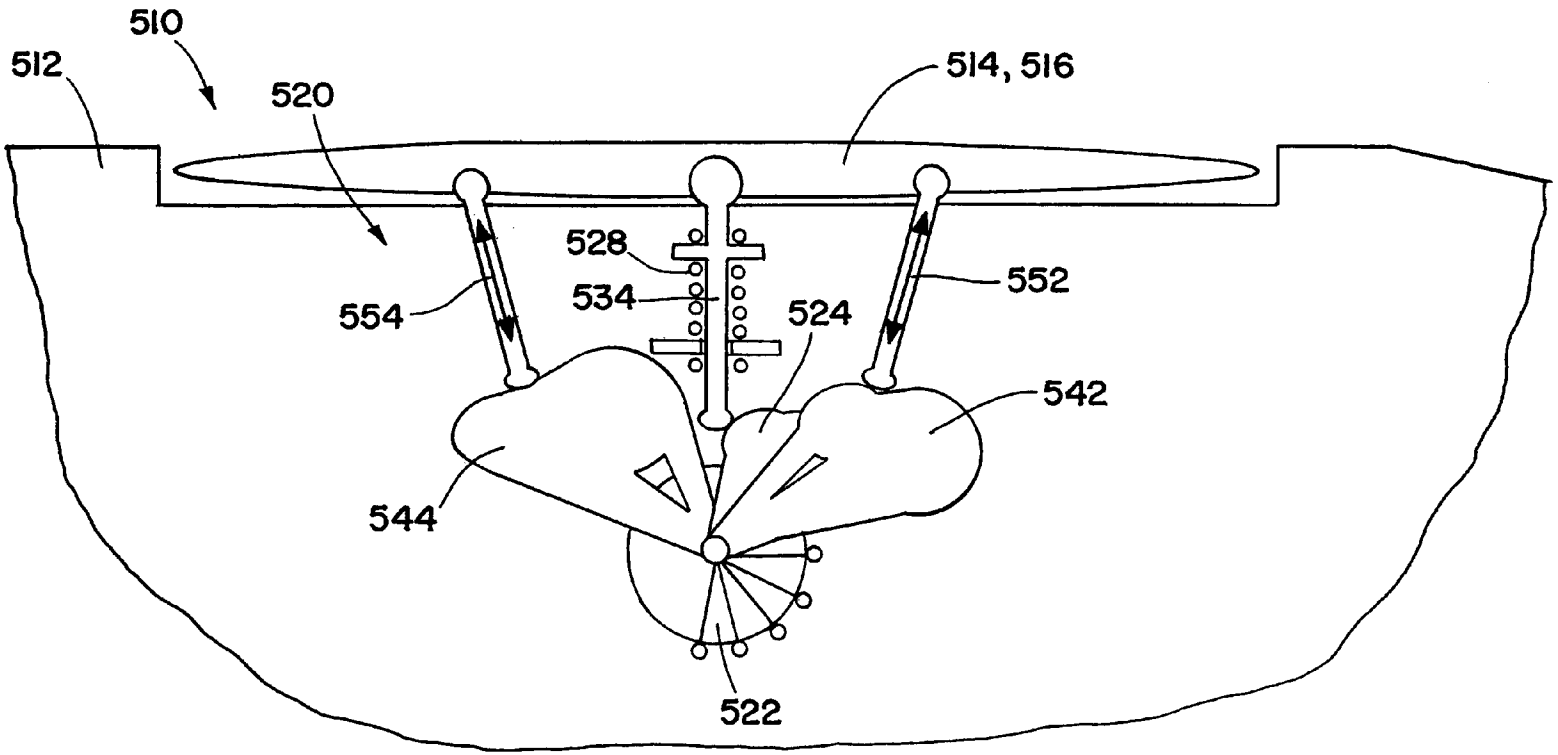
FIG. 19 is a cross-sectional view from the side of an air vehicle according to yet another alternate embodiment of the invention.

FIG. 19 illustrates a variant on the mechanism 420 (FIG. 16), a mechanism 520 of an air vehicle 510 that is used to both unlock lifting surfaces 514 and 516 for deployment, and to change the pitch angle of the lifting surfaces 514 and 516 relative to a fuselage 512. The mechanism 520 thus serves as both a deployment mechanism and a control mechanism. The unlocking mechanism 520 is similar to that of the mechanism 420, with a motor 522 used to turn a locking cam 524 to raise a follower 534, against the force of a locking spring 528, to raise the lifting surfaces 514 and 516 in order to deploy the lifting surfaces 514 and 516. After deployment, the mechanism 520 may be configured such that the locking cam 524 gets out of engagement with the motor 522.

The motor 522 is also coupled to a forward cam 542 and an aft cam 544. The cams 542 and 544 are engaged by a pair of followers, a forward position arm 552 and an aft position arm 554, that are attached to the lifting surfaces 514 and 516, such as through a stiffening box (not shown) that is between the lifting surfaces 514 and 516. As the motor 522 turns, the cams 542 and 544 turn, raising and lowering the position arms 552 and 554 to change the pitch of the lifting surfaces 514 and 516. Changing pitch allows the angle of attack of the lifting surfaces (wings) 514 and 516 to be controlled.

Figure 20:
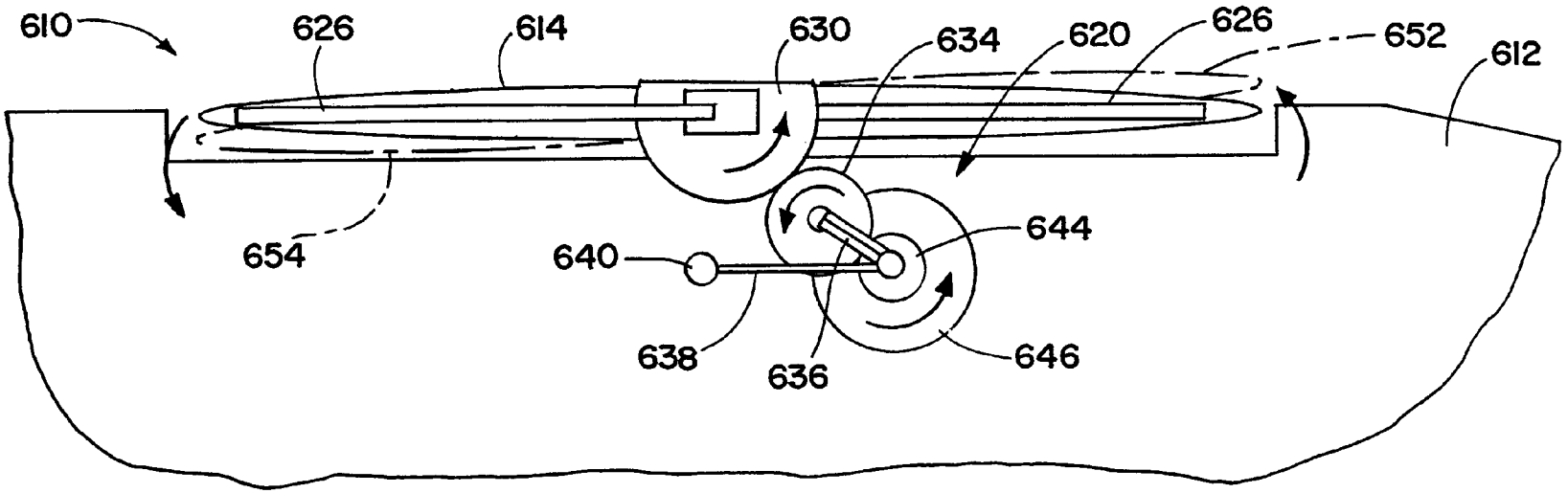
FIG. 20 is a cross-sectional view from the side of an air vehicle according to a further alternate embodiment of the invention.
Figure 21:
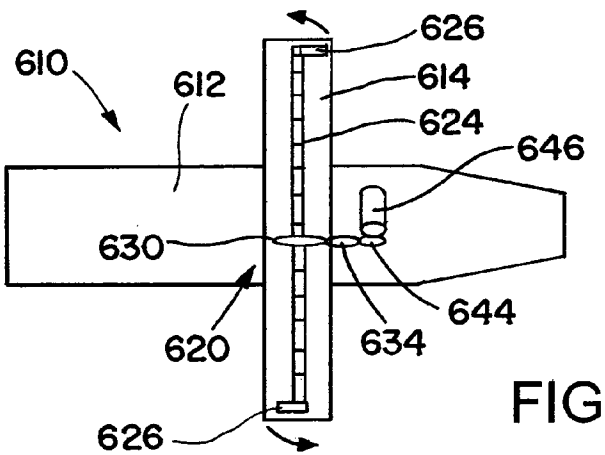
FIG. 21 is a plan view of the air vehicle of FIG. 20.

FIGS. 20 and 21 shows another mechanism, a control mechanism 620 for changing twisting a lifting surface (wing) 614 relative to a fuselage 612 of an air vehicle 610, in order to effect roll control. The mechanism 620 may be combined with a pitch control mechanism, such as the mechanism 520 (FIG. 19). The mechanism 620 includes a spanwise member, for example a torsion chain 624, that is coupled to a pair of torsion bars 626. The torsion chain 624 and the torsion bars 626 may be similar to the torsion chain 84 (FIG. 10) and the torsion bars 86 (FIG. 10) described above. The torsion chain 624 is secured to a half-moon gear 630 that is near the center of the span of the lifting surface 614. The half-moon gear 630 is engaged with a second gear 634 that is on a spring-loaded lever arm 636 that allows the gear 634 to move up when the lifting surface 614 is deployed, and to follow any pitch control motion of the lifting surface 614. The lever arm 636 is coupled to a spring 638 that in turn is secured to a rigid attachment point 640 on the fuselage 612. The spring 638 and the lever arm 636 keep the gears 630 and 634 engaged when the lifting surfaces 614 is translated up and down. Alternatively, the spring-arm could be replaced with a rigid element, or the shaft of the second gear 634 could be restrained directly to the airframe.

The second gear 634 is also coupled to a motor shaft 644 of a motor 646. The motor 646 turns the shaft 644, which turns the gear 634, which turns the half-moon gear 630. This results in a torque being put on the torsion chain 624. Although the torsion chain 624 is laterally flexible (it is made up of linked rigid elements and therefore is able to be rolled up, at least to some extent), the torsion chain 624 is rotationally stiff. Torque on the torsion chain 624 is transmitted to the torsion bars 626, which twists the lifting surface 614, deforming the lifting surface 614 such that (for example) one end of the lifting surface 614 goes up at the trailing edge (indicated at 652), and the opposite end of the lifting surface 614 goes up at the leading edge (indicated at 654). The result is a roll moment placed on the air vehicle 610, with the mechanism 620 able to control roll of the air vehicle 610.

Figure 22:
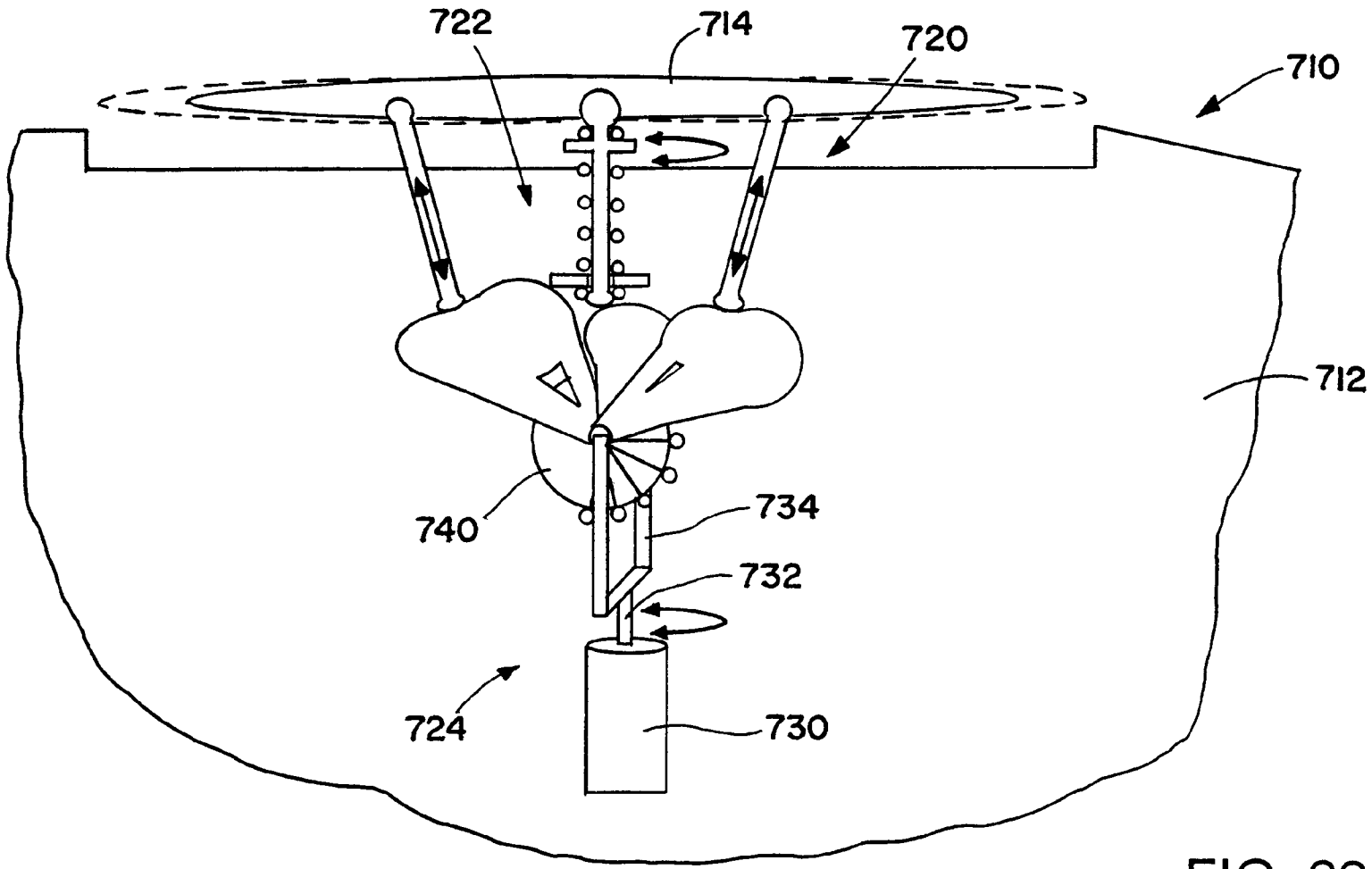
FIG. 22 is a cross-sectional view from the side of an air vehicle according to a still further alternate embodiment of the invention.
Figure 23:
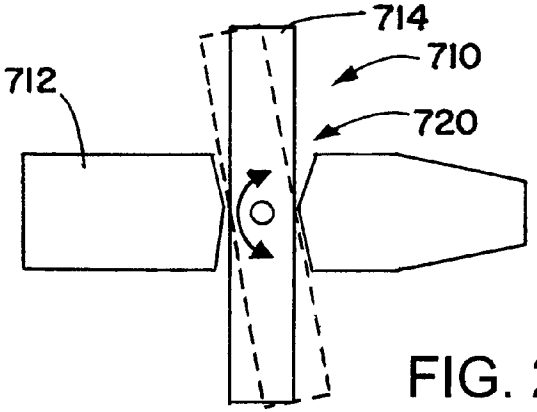
FIG. 23 is a plan view of the air vehicle of FIG. 22.

FIGS. 22 and 23 show another variant, a mechanism 720 that is part of an air vehicle 710. The mechanism 720 includes a pitch control 722 for deploying a lifting surface (wing) 714 and changing the pitch of the lifting surface 714, as well as a roll control 724 for twisting the lifting surface 714. The pitch control 722 has essentially the same elements as the mechanism 520 (FIG. 19). The roll control 724 has a roll control motor 730 that is used to turn (twist) the lifting surface 714 and the pitch control 722. A motor shaft 732 emerging from the roll control motor 730 is coupled to a motor armature 734 that in turn is coupled to a pitch control motor 740 that is part of the pitch control 722. Turning the motor shaft 732 thus twists the entire pitch control 722, as well as the lifting surface (wing) 714, as illustrated in FIG. 23. By twisting the lifting surface 714 so that one tip of the wing moves forward, and the opposite tip moves aft, a lift differential is created, which creates a roll moment on the air vehicle 710.

Figure 24A:
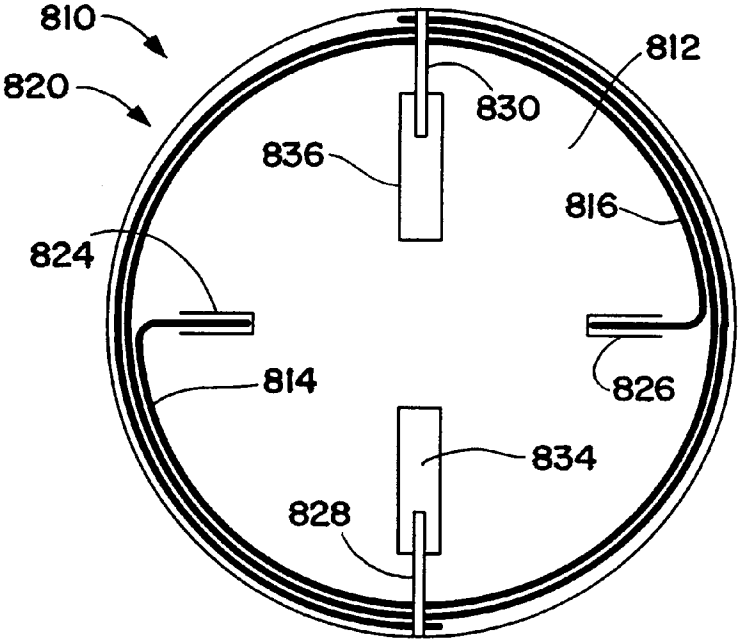
FIG. 24A is a front cross-sectional view of an air vehicle according to another embodiment of the invention.
Figure 24B:
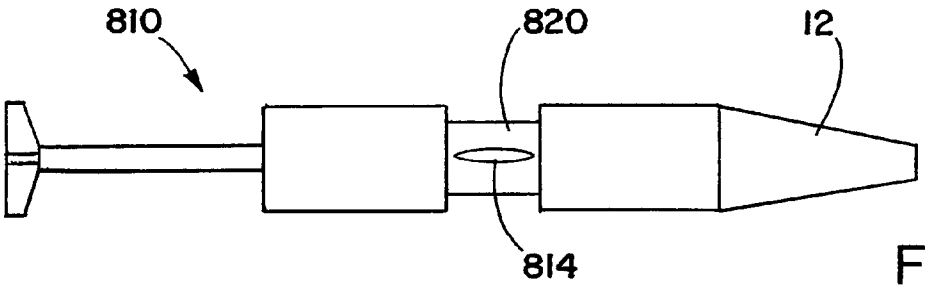
FIG. 24B is a side view of the air vehicle of FIG. 24A, with lifting surfaces deployed.

FIGS. 24A and 24B show an air vehicle 810 in which the lift surfaces 814 and 816 are wrapped around a midbody 820 of a fuselage 812. The lift surfaces 814 and 816 are anchored at respective anchor points 824 and 826 in the fuselage 812. The lift surfaces 814 and 816 wrap around the midbody 820, wrapping in the same direction and overlapping themselves and one another, and are held in place by pins 828 and 830 that fit into respective slots in the lift surfaces 814 and 816. The pins 828 and 830 may be retracted by solenoids 834 and 836 to release the lift surfaces 814 and 816 for deployment.

The lift surfaces 814 and 816 may have features similar to those in other embodiments described herein. The lift surfaces 814 and 816 may have any of a wide variety of lengths. The anchor points 824 and 826 may be elsewhere on the fuselage 812, for example higher up on the fuselage 812. The anchor points 824 and 826 may be fixed, or may be hinged to motors or other actuators for control purposes. As another alternative, a single lifting surface that passes through the fuselage could be used in place of the separate lift surfaces 814 and 816.

The air vehicles described herein may be any of a variety of types of air vehicles, for example projectiles, mortar rounds, missiles, unmanned aerial vehicles (UAVs), or other air vehicles launched or deployed from launch tubes or other launchers, or stored and/or transported in storage containers. The various lift surfaces are simple, lightweight, compact in storage, and can provide high lift-to-drag ratios. A length-to-drag ratio of 4 to 6 may be achievable for mortars/projectiles, though much higher ratios are possible for other types of smaller, lower wing-loading, or blended body air vehicles with very high aspect ratio lifting surface(s). For example length-to-drag ratios of 30 to 60 are potentially feasible when used on a small, light, low drag vehicle. These values are only examples, and length-to-drag ratios outside of the range of 4 to 60 may also be achievable.

Figure 25:
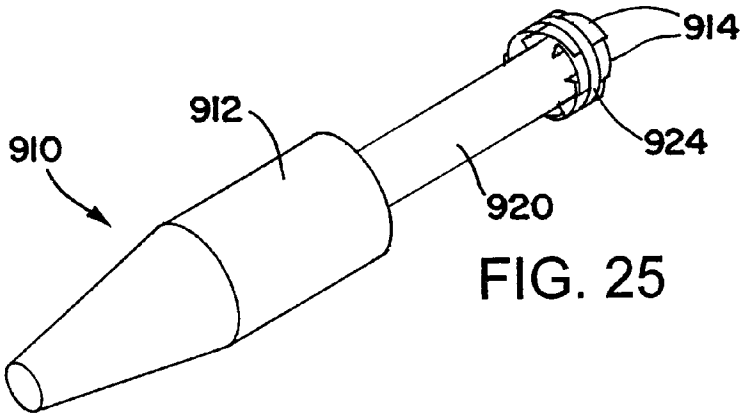
FIG. 25 is an oblique view of an air vehicle according to yet another embodiment of the invention.
Figure 26:
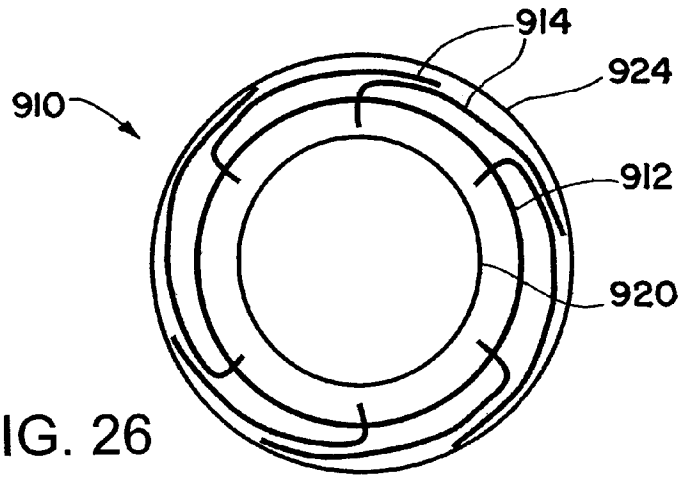
FIG. 26 is a cross-sectional view of the air vehicle of FIG. 25, with the tail surfaces in the stowed condition.
Figure 27:
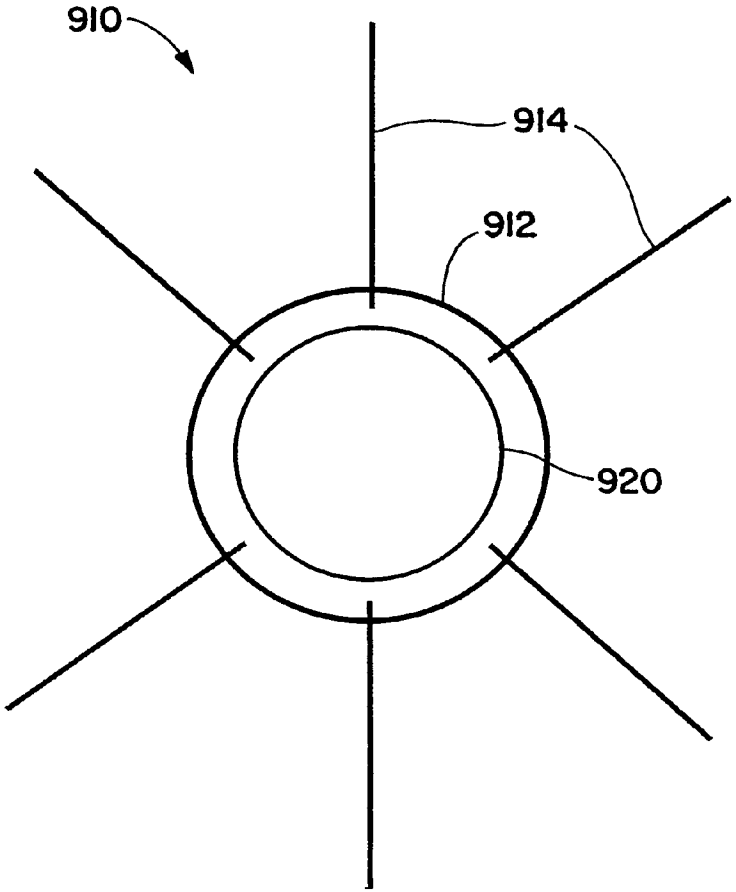
FIG. 27 is a cross-sectional view of the air vehicle of FIG. 25, with the tail surfaces in the deployed condition.

FIGS. 25-27 show an air vehicle 910, for example a mortar round, that includes tail fins 914 that wrap around an aft part of a fuselage 912, such as a tail boom 920. The fins 914 are secured in a stowed condition (FIG. 26) by a combustible restraint 924. The combustible restraint 924 burns during a propellant burn of a propellant of the air vehicle 910, releasing the tail fins 914 to a deployed condition, shown in FIG. 27. The tail fins 914 advantageously automatically deploy during flight of the air vehicle 910. The tail fins 914 may be lift-producing surfaces having the same characteristics of the various embodiments of lift-producing surfaces described above.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An air vehicle comprising:

a fuselage; and one or more lifting surfaces that deploy from a stowed condition, with the one or more lifting surfaces wrapped around at least part of the fuselage, to a deployed condition;

wherein the one or more lifting surfaces each have a top member and a bottom member, with the top member and the bottom member connected at a leading edge and a trailing edge of the lifting surface, and with the top member and the bottom member have a greater physical separation from one another, between the leading edge and the trailing edge, when the lifting surface is in the deployed condition, compared to when the lifting surface is in the stowed condition;

further comprising each of the one or more lifting surfaces having stiffeners between the top member and the bottom member;

wherein the stiffeners include opposing stiffeners that do not cross a centerline between the top member and the bottom member, when the one or more lifting surfaces are in the deployed condition.

2. The air vehicle of claim 1, wherein in the stowed condition the top member and the bottom member are in contact with one another between the leading edge and the trailing edge.

3. The air vehicle of claim 1, wherein the top member and the bottom member are welded together at the leading edge and the trailing edge.

4. The air vehicle of claim 1, wherein the top member and the bottom member are coupled together by flexible overlapping material at the leading edge and the trailing edge.

5. The air vehicle of claim 4, wherein the flexible material is a flexible fabric material.

6. The air vehicle of claim 1, wherein the members are buckled to curve in the same direction when in the stowed condition, and are chambered in opposite directions in the deployed condition.

7. The air vehicle of claim 1, wherein the stiffeners include interlaced stiffeners.

8. The air vehicle of claim 7, wherein the interlaced stiffeners include multiple upper stiffeners stacked over multiple lower stiffeners.

9. The air vehicle of claim 1 wherein the one or more lifting surfaces include a tapered lifting surface that in the deployed condition has a non-constant airfoil shape as a function of span.

10. The air vehicle of claim 1 further comprising a deployment mechanism for maintaining the one or more lifting surfaces in the stowed condition, and for deploying the one or more lifting surfaces to the deployed condition.

11. The air vehicle of claim 10, wherein the deployment mechanism includes a pin that passes through a hole in at least one of the one or more lifting surfaces, to secure the lifting surfaces in the stowed configuration; and wherein removal of the pin causes deployment of the one or more lifting surfaces to the deployed condition.

12. The air vehicle of claim 10, wherein the deployment mechanism includes a mechanism that provides a force that disengages the one or more lifting surfaces from one or more mechanical constraints of the fuselage.

13. The air vehicle of claim 1, wherein the one or more lifting surfaces include one or more wings.

14. The air vehicle of claim 1, wherein the air vehicle is a mortar round.

15. An air vehicle comprising:

a fuselage; and one or more lifting surfaces that deploy from a stowed condition, with the one or more lifting surfaces wrapped around at least part of the fuselage, to a deployed condition;

wherein the one or more lifting surfaces each have a top member and a bottom member, with the top member and the bottom member connected at a leading edge and a trailing edge of the lifting surface, and with the top member and the bottom member have a greater physical separation from one another, between the leading edge and the trailing edge, when the lifting surface is in the deployed condition, compared to when the lifting surface is in the stowed condition;

further comprising a torsion chain, and torsion bars coupled to the torsion chain;

wherein the torsion chain and the torsion bars are operatively coupled to the one or more lifting surfaces.

16. The air vehicle of claim 15, wherein in the stowed condition the top member and the bottom member are in contact with one another between the leading edge and the trailing edge.

17. The air vehicle of claim 15, wherein the top member and the bottom member are welded together at the leading edge and the trailing edge.

18. An air vehicle comprising:

a fuselage;

one or more lifting surfaces that deploy from a stowed condition, with the one or more lifting surfaces wrapped around at least part of the fuselage, to a deployed condition; and a control mechanism that changes configuration of the one or more lifting surfaces, in the deployed condition, during flight of the air vehicle;

wherein the one or more lifting surfaces each have a top member and a bottom member, with the top member and the bottom member connected at a leading edge and a trailing edge of the lifting surface, and with the top member and the bottom member have a greater physical separation from one another, between the leading edge and the trailing edge, when the lifting surface is in the deployed condition, compared to when the lifting surface is in the stowed condition; and wherein the control mechanism includes at least one of a pitch control mechanism, a roll control mechanism, or a mechanism for twisting the one or more lifting surfaces.

19. The air vehicle of claim 18, wherein the control mechanism includes the pitch control mechanism.

20. The air vehicle of claim 18, wherein the control mechanism includes the roll control mechanism.

21. The air vehicle of claim 18, wherein the control mechanism includes the mechanism for twisting the one or more lifting surfaces.

* * * * *